US011516573B2

(12) United States Patent
Yang

(10) Patent No.: US 11,516,573 B2
(45) Date of Patent: Nov. 29, 2022

(54) SPLIT BONE CONDUCTION EARPHONE

(71) Applicant: Shenzhen Mengda Network Technology Co., Ltd., Guangdong (CN)

(72) Inventor: Chuangchao Yang, Guangdong (CN)

(73) Assignee: Shenzhen Mengda Network Technology Co., Ltd., Guangdong (CN)

( * ) Notice: Subject to any disclaimer, the term of this patent is extended or adjusted under 35 U.S.C. 154(b) by 0 days.

(21) Appl. No.: 17/376,147

(22) Filed: Jul. 14, 2021

(65) Prior Publication Data

US 2022/0095032 A1 Mar. 24, 2022

(30) Foreign Application Priority Data

Sep. 19, 2020 (CN) ..... 202022071074.8
Apr. 1, 2021 (CN) ..... 202120673274.2

(51) Int. Cl.
*H04R 25/02* (2006.01)
*H04R 1/10* (2006.01)

(52) U.S. Cl.
CPC ..... *H04R 1/1016* (2013.01); *H04R 2460/13* (2013.01)

(58) Field of Classification Search
CPC .. H04R 1/1025; H04R 1/105; H04R 2225/31; H04R 25/602; H04R 25/65; H04R 2225/77; H04R 2460/13
See application file for complete search history.

(56) References Cited

U.S. PATENT DOCUMENTS 7,916,884 B2 * 3/2011 Kah, Jr. ..... H04R 25/02 381/328
9,022,917 B2 * 5/2015 Kasic ..... H04R 25/606 600/25
9,210,521 B2 * 12/2015 Kasic ..... H04R 25/606
9,788,097 B2 * 10/2017 Bullen ..... G06F 3/162
11,109,142 B2 * 8/2021 Zhang ..... H04R 1/1066
11,166,094 B2 * 11/2021 Li ..... H04R 1/44
(Continued)

FOREIGN PATENT DOCUMENTS

CN 111200768 A * 5/2020
CN 113949957 A * 1/2022
(Continued)

*Primary Examiner* — Ryan Robinson
(74) *Attorney, Agent, or Firm* — JCIP Global Inc.

(57) ABSTRACT

The present application relates to a split bone conduction earphone including an earphone body, an ear hook and a bone conduction vibrator, a transmission surface of the bone conduction vibrator is provided on the side wall of the earphone body; the ear hook is provided on the earphone body for cooperating with the earphone body to make the transmission surface of the bone conduction vibrator firmly attached to a predetermined position; the earphone body includes a first housing and a second housing; the first housing is provided with an elastic support piece that matches the contour of the human inner ear; the first housing and the second housing form a bone conduction cavity and a battery cavity; only the bone conduction vibrator is installed on the bone conduction cavity, and the battery cavity is installed with a battery to power the bone conduction vibrator.

10 Claims, 4 Drawing Sheets

(56) References Cited

U.S. PATENT DOCUMENTS

| | | | | |
|---|---|---|---|---|
| 11,317,191 | B2 * | 4/2022 | Li | H04R 1/105 |
| 11,368,780 | B1 * | 6/2022 | Kong | H04R 1/1008 |
| 11,388,506 | B2 * | 7/2022 | Wang | H04R 1/105 |
| 2004/0105566 | A1 * | 6/2004 | Matsunaga | H04R 1/1066 381/381 |
| 2006/0120546 | A1 * | 6/2006 | Tanaka | H04R 1/1016 381/370 |
| 2012/0029267 | A1 * | 2/2012 | Ball | H04R 25/606 600/25 |
| 2014/0121447 | A1 * | 5/2014 | Kasic | H04R 25/606 600/12 |
| 2021/0116723 | A1 * | 4/2021 | Wang | H04R 1/02 |
| 2021/0250699 | A1 * | 8/2021 | Qi | H04R 1/00 |
| 2021/0352394 | A1 * | 11/2021 | Wen | H04R 1/1075 |
| 2022/0095029 | A1 * | 3/2022 | Zheng | H04R 1/1008 |
| 2022/0107686 | A1 * | 4/2022 | Baba | H04R 1/1041 |

FOREIGN PATENT DOCUMENTS

| | | | | | |
|---|---|---|---|---|---|
| CN | 114374905 | A * | 4/2022 | | |
| KR | 100865959 | B1 * | 10/2008 | | |
| KR | 102389143 | B1 * | 4/2022 | | |
| WO | WO-2021078339 | A1 * | 4/2021 | | H04R 1/105 |
| WO | WO-2021143117 | A1 * | 7/2021 | | H04R 1/105 |

* cited by examiner

SPLIT BONE CONDUCTION EARPHONE

CROSS-REFERENCE TO RELATED APPLICATION

The present application is based on and claims the priority benefits of China applications No. 202022071074.8, filed on Sep. 19, 2020, and No. 202120673274.2, filed on Apr. 1, 2021. The entirety of each of the above-mentioned patent applications is hereby incorporated by reference herein and made a part of this specification.

BACKGROUND

Technical Field

The present application relates to the field of earphone technology, especially to a split bone conduction earphone.

Description of Related Art

Bone conduction is a sound conduction manner of a split bone conduction earphone, that is, sound is converted into mechanical vibrations of different frequencies, and the sound waves are transmitted through the human skull, bone labyrinth, inner ear lymphatic fluid, spiral organs, auditory nerve, and auditory center. Compared with the classic sound conduction manner that generates sound waves through a diaphragm, the bone conduction eliminates many steps of sound wave transmission, and can achieve a clear sound reproduction in a noisy environment, and sound waves will not affect others due to diffusion in the air. Earphones made with the bone conduction technology are called bone conduction earphones.

Some bone conduction earphones are integrally C-shaped. When the bone conduction earphones are actually worn, a transmission surface of a bone conduction vibrator used to transmit sound is closely attached to the bones of the human brain only by a clamping force of the bone conduction vibrator itself, and after the bone conduction earphones are stably worn, the sound can be heard through the transmission surface. However, during exercise of the wearer, the bone conduction earphone is subjected to gravity and external force, which may easily cause the instability of the bone conduction earphone.

Regarding the above-mentioned related technologies, the inventor believes that there is a defect of instability in wearing.

SUMMARY

In order to improve the stability of bone conduction earphones, the present application provides a split bone conduction earphone.

The split bone conduction earphone provided by the present application uses the following technical solutions.

A split bone conduction earphone includes an earphone body, an ear hook and a bone conduction vibrator, wherein a transmission surface of the bone conduction vibrator is provided on the side wall of the earphone body; the ear hook is provided on the earphone body for cooperating with the earphone body to make the transmission surface of the bone conduction vibrator firmly attached to a predetermined position; the earphone body includes a first housing and a second housing detachably mounted on the first housing; the first housing is provided with an elastic support piece that is configured to match the contour of the human inner ear; the elastic support piece is on the same side as the tail end of the ear hook; the first housing and the second housing form a bone conduction cavity and a battery cavity that are independent of each other and communicated with each other; only the bone conduction vibrator is installed on the bone conduction cavity, and the battery cavity is configured to install with a battery to power the bone conduction vibrator.

By adopting the above technical solution, when a person wears the bone conduction earphone, the ear hook hangs on the ear and the elastic support piece is positioned at the inside of the auricle. At this time, the ear hook, the elastic support piece and the earphone body cooperate with each other, which can make the bone conduction vibrator attached to the cartilage of the head, and then can facilitate the transmission surface of the bone conduction vibrator to transmit sound. In this way, it can effectively improve the stability and make it convenient for the user to wear. In addition, only the bone conduction vibrator is positioned on the bone conduction cavity, and the battery is positioned within the battery cavity, which can give the bone conduction vibrator a relatively independent space, which can effectively improve the sound quality and reduce the occurrence of sound leakage. Meanwhile, the existence of the battery can supply power to the bone conduction vibrator and related electronic devices. For this, it can improve the applicability of the bone conduction vibrator.

Alternatively, the side of the first housing for facing the human body is formed with an arc that is configured to match the contour of the human face.

By adopting the above technical solution, there is an arc that matches the contour of the human face, which can make the bone conduction earphone more ergonomic when worn, that is, under the cooperation with the ear hook, two ends of the first housing fitting the human face and the ear hook form a three-point support structure. For this, the bone conduction vibrator can be closer to the face, thereby improving stability.

Alternatively, the first housing includes a fitting part, a connecting part and a supporting part that are integrally connected; the bone conduction vibrator is configured to be provided within the fitting part, and the transmission surface of the bone conduction vibrator is positioned at a surface of the fitting part facing the human body; the elastic support piece is configured to be provided on the side wall of the supporting part facing the human body, and the connecting part is provided between the fitting part and the supporting part for an external power supply to charge the battery.

By adopting the above technical solution, when the bone conduction earphones are actually worn, both the fitting part and the supporting part are in contact with the human facial cartilage, and a side of the fitting part and of the supporting part facing the human body form a clamping surface with a predetermined angle. For this, the transmission surface of the bone conduction vibrator is closer to the face. The provision of the connecting part is convenient for the external power supply to supply power to the battery.

Alternatively, a surface of the connecting part for facing the human body is lower than a surface of the fitting part and a surface of the supporting part, and a groove is formed among the connecting part, the fitting part and the supporting part.

By adopting the above technical solution, the existence of the groove not only facilitates to cooperate with the fitting part and the supporting part to attach to the face, at the same time, but also simplifies the structure of the earphone body while facilitating the charging of the battery. More importantly, the existence of the groove can effectively divide the battery cavity and the bone conduction cavity. For this, it can make the sound transmitted by the bone conduction vibrator clearer and more direct, which can effectively improve the sound quality and reduce the occurrence of sound leakage.

Alternatively, the groove is provided with a charging contact, and the battery is configured to be charged by an external charging box through the charging contact.

By adopting the above technical solution, the charging contact positioned at the groove can effectively increase the service life, because the charging contact will not touch the face when worn. For this, it can prevent sweat from contacting the charging contact, and it can also avoid oxidation, short-circuit and other adverse conditions.

Alternatively, the supporting part is formed with a clamping slot snap-fitted with a snap-fit piece, and the elastic support piece includes a positioning frame snap-fitted with the snap-fit piece and an elastic rubber plug is sleeved around a surface of the positioning frame.

By adopting the above technical solution, the clamping manner of the snap-fit piece and the positioning frame facilitates the positioning frame to be installed on the supporting part. The elastic rubber plug is provided with elasticity and flexibility. For this, it can be more suitable for ear wear.

Alternatively, a speaker for playing audio sounds is provided within the elastic support piece.

By adopting the above technical solution, the existence of a speaker facilitates the direct playback of sound through the speaker, thereby improving the applicability of the bone conduction earphone, that is, the bone conduction earphone can use the bone conduction vibrator to transmit sound, or play music directly.

Alternatively, the connecting part is provided with a partition plate on which a connection pipe is provided; a conductive post electrically connected to the battery is plugged within the connection pipe; the conductive post protrudes out of the surface of the groove, and the protruding portion of the conductive post is set as the charging contact.

By adopting the above technical solution, the provision of the connection pipe can play a protective role, and thus facilitate the external power supply to charge the battery through the conductive post.

Alternatively, the second housing is provided with a transfer switch for switching audio sounds.

By adopting the above technical solution, the provision of the toggle switch is convenient to switch audio, so that the required audio sound can be selected according to actual needs.

Alternatively, a sweat groove for draining sweat is formed on the ear hook.

By adopting the above technical solution, the provision of the sweat groove facilitates the timely discharge of sweat flowing onto the ear hook, avoiding the sweat from contacting the skin for a long time, thereby effectively improving the wearing comfort.

In summary, the present application includes at least one of the following beneficial technical effects.

1. The fitting part, the supporting part and the ear hook cooperate with each other, which can make the bone conduction vibrator close to the facial cartilage, which can effectively improve the wearing stability and make it convenient for the user to wear;

2. A dedicated bone conduction cavity is provided for the bone conduction vibrator, which can reduce the occurrence of sound leakage and improve the user experience;

3. The way of locating the charging contact at the groove can prevent sweat from contacting the charging contact, and can also avoid bad conditions such as oxidation and short circuit.

DESCRIPTION OF THE EMBODIMENTS

The present application is described in further detail below in conjunction with FIGS. 1-4.

Figure 1:
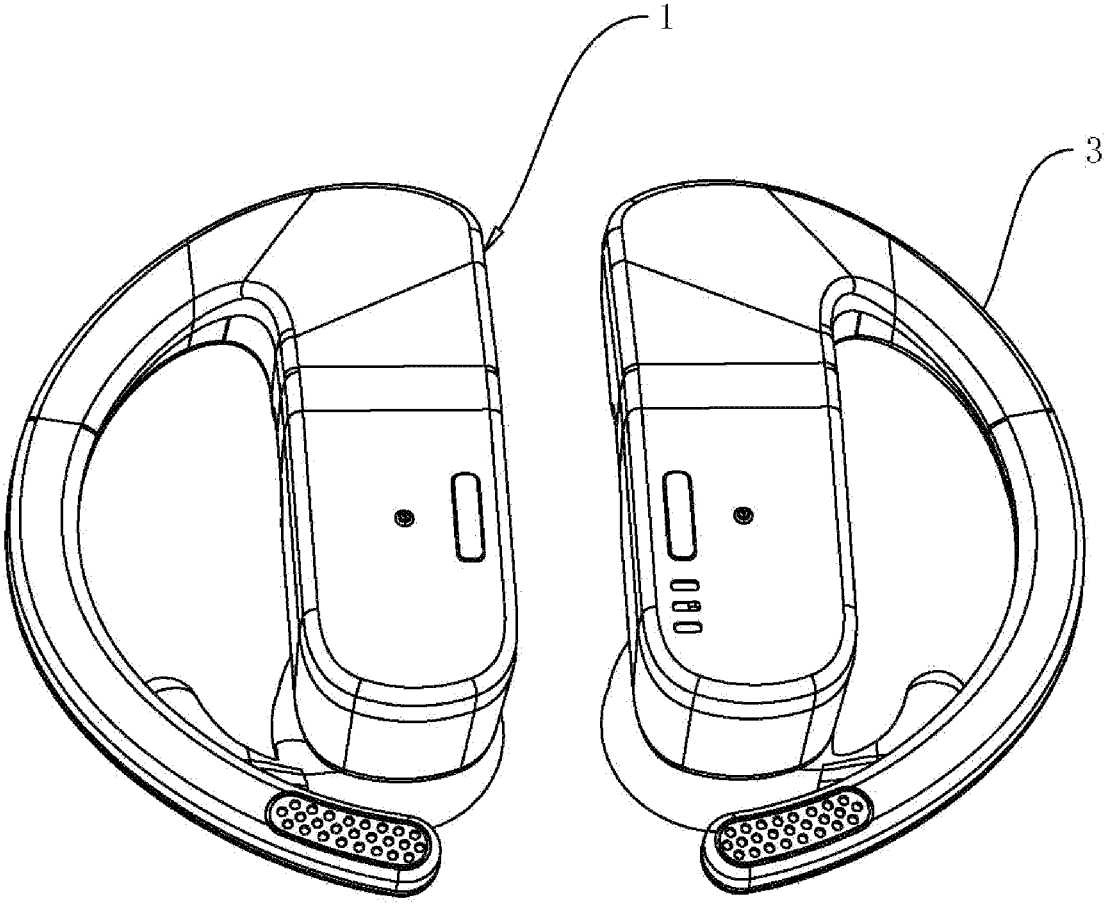
FIG. 1 is an overall schematic diagram of a split bone conduction earphone according to an embodiment of the present application.
Figure 2:
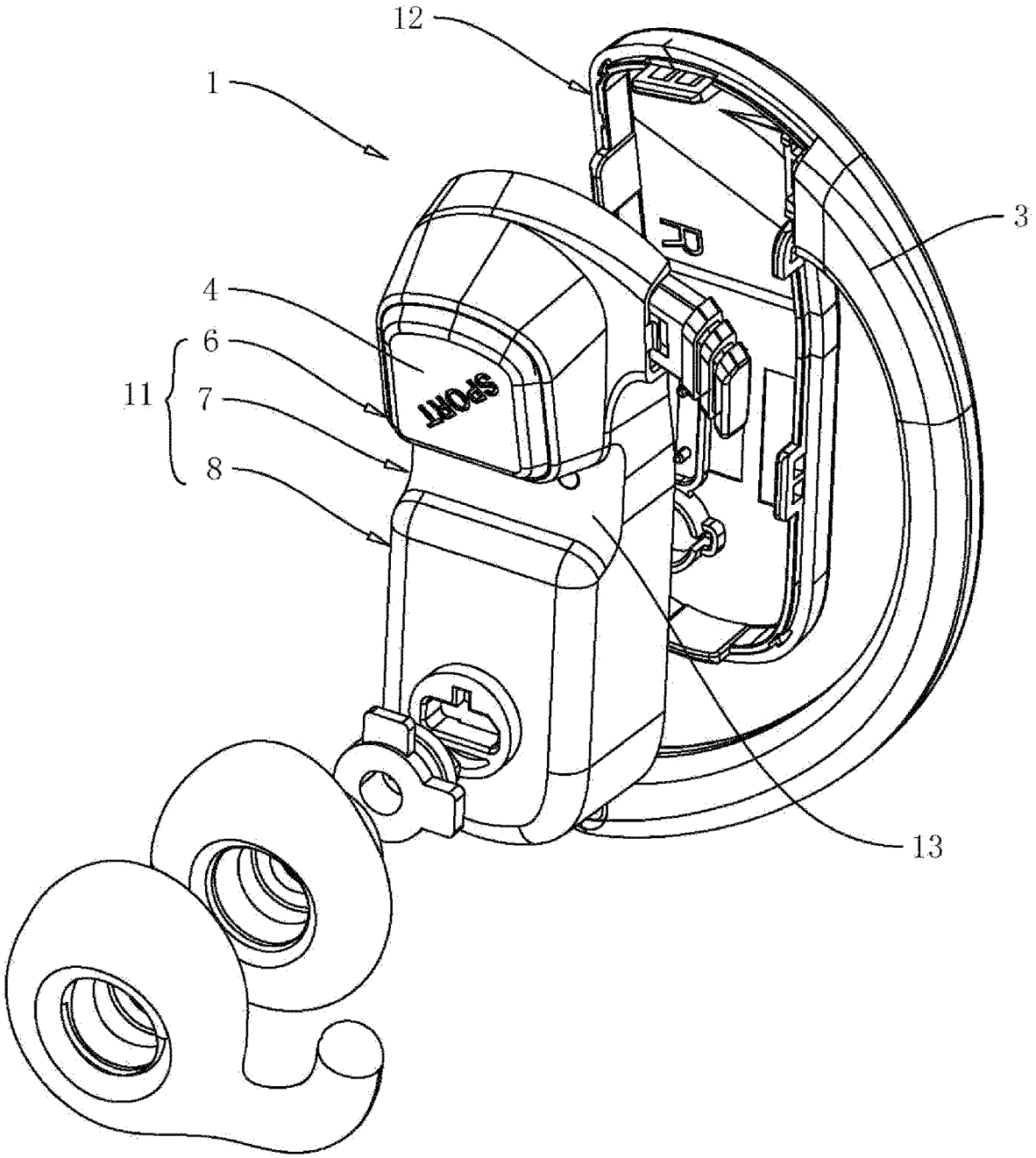
FIG. 2 is an exploded schematic diagram of a first housing and a second housing according to an embodiment of the present application.

The present application embodiment discloses a split bone conduction earphone, which is used by the user to listen to sounds. Refer to FIGS. 1 and 2, it includes an earphone body 1, the ear hook 3, an audio playback module (not shown), a battery 2 (referring to FIG. 3) and a bone conduction vibrator 4. Referring to FIG. 2, the earphone body 1 includes a first housing 11 and a second housing 12. In this embodiment, the first housing 11 and the second housing 12 are snap-fitted with each other, and when they are snap-fitted, an accommodation cavity is formed. In other embodiments, the connection between the first housing 11 and the second housing 12 may also be plugging and riveting. The audio player module (not shown), the battery 2 and the bone conduction vibrator 4 are installed in the accommodation cavity, and a transmission surface of the bone conduction vibrator 4 is exposed on the surface of the first housing 11.

Figure 3:
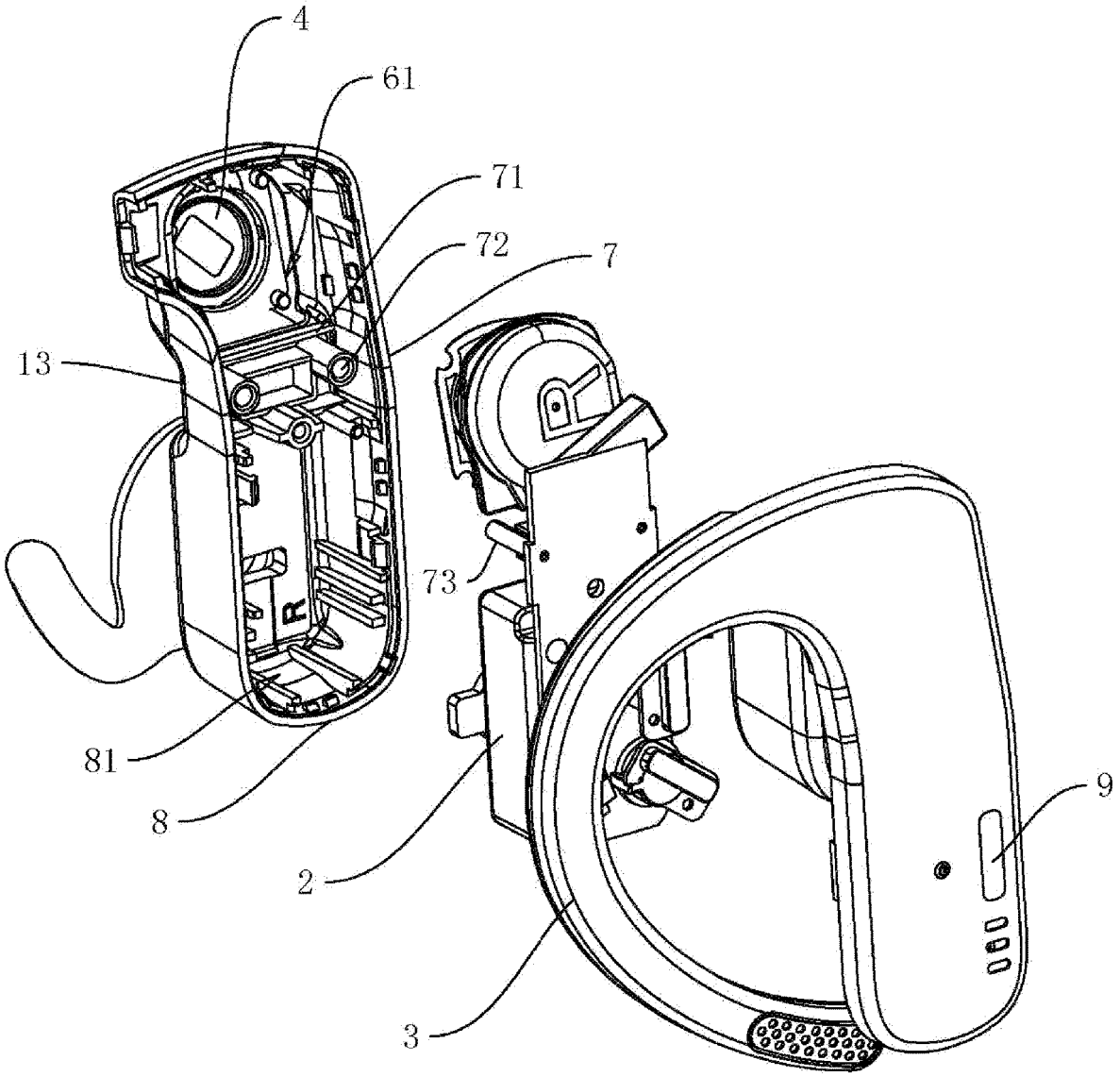
FIG. 3 is an exploded schematic diagram of a connecting part and a supporting part according to an embodiment of the present application.

Referring to FIGS. 2 and 3, the battery 2 is used to power the audio playback module and the bone conduction vibrator 4. The ear hook 3 is installed at the connection between the first housing 11 and the second housing 12, and is integrally overall shape. In the actual use, ear hook 3 may be hung on the ear to stabilize the position of the earphone body 1 and further stabilize the position of the bone conduction vibrator 4. In the second housing 12, a transfer switch 9 is provided specifically as a contact switch, which is electrically connected to the audio playback module for switching audio sounds. In other embodiments, the transfer switch 9 may also be a toggle switch. However, any type switch is possible, provided that it can achieve the effect of switching audio sounds. In order to drain the sweat on the ear hook 3 in time, a sweat groove (not shown) is formed on the ear hook 3, that extends from the top of the ear hook 3 to the tail end of the ear hook. The existence of the sweat groove can discharge sweat in time, which can improve wearing comfort.

Referring to FIG. 2, the side of the first housing 11 facing the human body is formed with an arc that matches the contour of the human face. The first housing 11 is integrally formed and specifically includes a fitting part 6, a connecting part 7 and a supporting part 8. The fitting part 6 is a fitting housing, the supporting part 8 is a supporting housing, and the connecting part 7 is a connecting housing connected between the fitting part 6 and the supporting part 8. In this embodiment, a groove 13 is formed among the fitting part 6, the connecting part 7 and the supporting part 8. Specifically, the surface of the connecting part 7 facing the human body is lower than the surface of the fitting part 6 and the surface of the supporting part 8.

Referring to FIG. 2, in order to further stabilize the position of the bone conduction vibrator 4 so that the transmission surface of the bone conduction vibrator 4 is close to the cartilage of the human face, setting a side of the fitting part 6 facing the human body as a first side and the side of the supporting part 8 facing the human body as a second side, when the bone conduction earphones are actually worn, both the first side and the second side cooperate with the ear hook 3 and can just be close to the cartilage of the human face. In fact, the first side, the second side and the ear hook 3 form a three-point support structure, which indirectly makes the transmission surface of the bone conduction vibrator 4 close to the cartilage of the face.

Referring to FIG. 3, in order to reduce the sound leakage, the fitting part 6 is provided with a bone conduction cavity 61 specifically for accommodating the bone conduction vibrator 4, and the supporting part 8 is provided with a battery cavity 81 for accommodating a battery 2 that is communicated with the bone conduction cavity 61. On the side of the connecting part 7 facing the battery cavity 81, there is provided a partition plate 71, on which a hollow connection pipe 72 is provided. A conductive post 73 electrically connected to the battery 2 is plugged within the connection pipe 72, and there are two conductive posts 73, both of which just protrude out of the surface of the groove 13, and the protruding end faces of the conductive posts 73 are positioned at the same horizontal plane as the end face of the groove 13. The protruding part of the conductive post 73 is set as a charging contact 14, and an external power source such as a charging box can charge the battery 2 through the charging contact 14.

Figure 4:
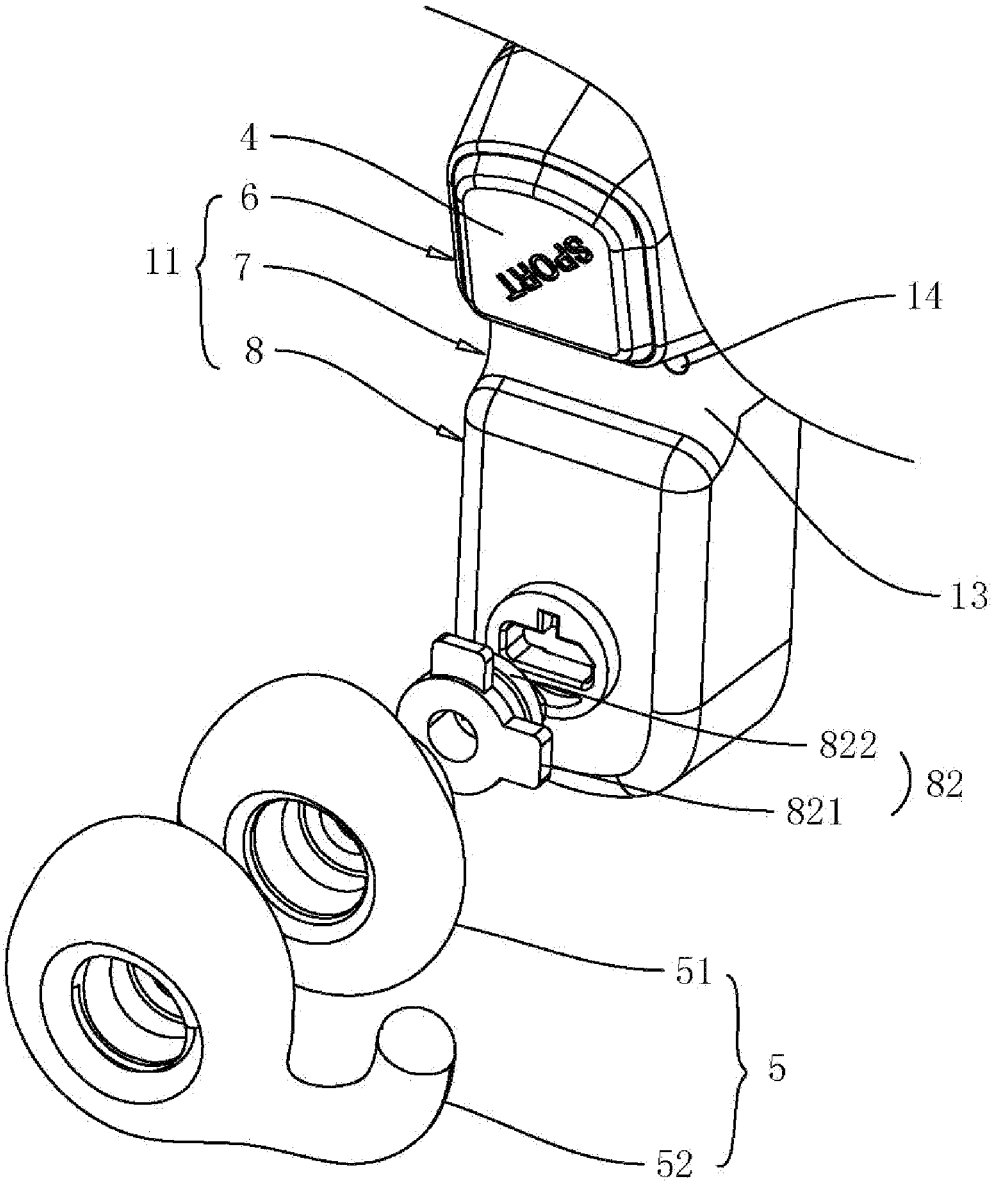
FIG. 4 is an exploded schematic diagram of an elastic support piece and a snap-fit piece according to an embodiment of the present application.

Referring to FIG. 4, in order to further stabilize the stability of the transmission surface of the bone conduction vibrator 4, on the side wall of the supporting part 8 facing the human body is provided with an elastic support piece 5 that matches the contour of the human inner ear, and the elastic support piece 5 is positioned at the same side as the tail end of the ear hook 3 (referring to FIG. 3). Specifically, the supporting part 8 is formed with a clamping slot snap-fitted with a snap-fit piece 82. The snap-fit piece 82 includes a clamping block 822 interference-fitted with the clamping slot and a positioning block 821 installed on the clamping block 822 and perpendicular to the axis of the clamping block 822. The elastic support piece 5 includes a positioning frame 51 and an elastic rubber plug 52. The positioning frame 51 is made of elastic material, and is snap-fitted with the clamping block 822. The elastic rubber plug 52 is sleeved around the outer surface of the positioning frame 51, and fits with the contour of the inner ear. In other embodiments, the elastic support piece 5 is provided with a speaker installed in the positioning frame 51 and electrically connected to the audio playback module to play the sound emitted by the audio playback module. In this way, the bone conduction earphone can not only transmit sound by the bone conduction vibrator 4, but also transmit sound through the speaker.

The implementation principle of the split bone conduction earphone of the present application is that: when the user wears the bone conduction earphone through the ear hook 3, both the first side and the second side abut the cartilage of the human face, and in cooperation with the clamping force of ear hook 3 on the ear enables the transmission surface of the bone conduction vibrator 4 to be close to the cartilage of the human face. Based on this, the sound can be easily heard.

The above are all preferred embodiments of the present application, and do not limit the scope of protection of the present application accordingly. Therefore, all equivalent changes made in accordance with the structure, shape, and principle of the present application should be covered within the scope of protection of the present application.

What is claimed is:

1. A split bone conduction earphone, comprising an earphone body, an ear hook and a bone conduction vibrator, wherein a transmission surface of the bone conduction vibrator is provided on a side wall of the earphone body; the ear hook is provided on the earphone body for cooperating with the earphone body to make the transmission surface of the bone conduction vibrator firmly attached to a predetermined position; the earphone body comprises a first housing and a second housing detachably mounted on the first housing; the first housing is provided with an elastic support piece that is configured to match a contour of a human inner ear; the elastic support piece is on a same side as a tail end of the ear hook; the first housing and the second housing form a bone conduction cavity and a battery cavity that are independent of each other and communicated with each other; only the bone conduction vibrator is installed on the bone conduction cavity, and the battery cavity is configured to install with a battery to power the bone conduction vibrator.

2. The split bone conduction earphone according to claim 1, wherein a side of the first housing for facing a human body is formed with an arc that is configured to match a contour of a human face.

3. The split bone conduction earphone according to claim 1, wherein the first housing comprises a fitting part, a connecting part and a supporting part that are integrally connected; the bone conduction vibrator is provided within the fitting part, and the transmission surface of the bone conduction vibrator is configured to be positioned at a surface of the fitting part facing a human body; the elastic support piece is configured to be provided on a side wall of the supporting part facing the human body, and the connecting part is provided between the fitting part and the supporting part for an external power supply to charge the battery.

4. The split bone conduction earphone according to claim 3, wherein a surface of the connecting part for facing the human body is lower than a surface of the fitting part and a surface of the supporting part, and a groove is formed among the connecting part, the fitting part and the supporting part.

5. The split bone conduction earphone according to claim 4, wherein the groove is provided with a charging contact, and the battery is configured to be charged by an external charging box through the charging contact.

6. The split bone conduction earphone according to claim 3, wherein the supporting part is formed with a clamping slot snap-fitted with a snap-fit piece, and the elastic support piece comprises a positioning frame snap-fitted with the snap-fit piece and an elastic rubber plug sleeved around a surface of the positioning frame.

7. The split bone conduction earphone according to claim 1, wherein a speaker for playing audio sounds is provided within the elastic support piece.

8. The split bone conduction earphone according to claim 5, wherein the connecting part is provided with a partition plate on which a connection pipe is provided; a conductive post electrically connected to the battery is plugged within the connection pipe; the conductive post protrudes out of a surface of the groove, and a protruding portion of the conductive post is set as the charging contact.

9. The split bone conduction earphone according to claim 1, wherein the second housing is provided with a transfer switch for switching audio sounds.

10. The split bone conduction earphone according to claim 1, wherein a sweat groove for draining sweat is formed on the ear hook.

* * * * *